US009206004B2

(12) United States Patent
Yamaguchi

(10) Patent No.: US 9,206,004 B2
(45) Date of Patent: Dec. 8, 2015

(54) IMAGE FORMING APPARATUS

(71) Applicant: Wataru Yamaguchi, Nissin (JP)

(72) Inventor: Wataru Yamaguchi, Nissin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 71 days.

(21) Appl. No.: 13/626,218

(22) Filed: Sep. 25, 2012

(65) Prior Publication Data

US 2013/0106046 A1 May 2, 2013

(30) Foreign Application Priority Data

Oct. 28, 2011 (JP) ..... 2011-237261

(51) Int. Cl.

| | |
|---|---|
| ***B65H 5/00*** | (2006.01) |
| ***B65H 5/06*** | (2006.01) |
| ***B41J 11/00*** | (2006.01) |
| ***B65H 11/00*** | (2006.01) |
| ***G03G 15/00*** | (2006.01) |
| ***B65H 5/36*** | (2006.01) |

(52) U.S. Cl.

CPC ..... *B65H 5/068* (2013.01); *B41J 11/0045* (2013.01); *B65H 5/36* (2013.01); *B65H 11/007* (2013.01); *G03G 15/6558* (2013.01); *B65H 2301/5125* (2013.01); *B65H 2404/1521* (2013.01); *B65H 2404/60* (2013.01); *B65H 2801/12* (2013.01); *G03G 2215/00662* (2013.01)

(58) Field of Classification Search

CPC ..... B65H 5/00; B65H 5/068; B65H 5/36; B65H 2402/31; B65H 2402/35; B65H 2404/152; B65H 2404/50; B65H 2404/51; B65H 2404/54; B65H 2404/60; B65H 2404/61; B65H 2301/5125; B41J 11/0045

USPC ..... 271/264, 271–275

See application file for complete search history.

(56) References Cited

U.S. PATENT DOCUMENTS

| | | | | |
|---|---|---|---|---|
| 5,620,174 | A * | 4/1997 | Taniguro et al. | 271/10.12 |
| 7,549,635 | B2 * | 6/2009 | Nakashima | 271/275 |

(Continued)

FOREIGN PATENT DOCUMENTS

| | | |
|---|---|---|
| JP | H02-303872 A | 12/1990 |
| JP | 2007-293263 | 11/2007 |
| JP | 2009-210899 | 9/2009 |

(Continued)

OTHER PUBLICATIONS

Sep. 1, 2015—(JP) Office Action—App 2011-237261.

*Primary Examiner* — Prasad Gokhale

(74) *Attorney, Agent, or Firm* — Banner & Witcoff, Ltd.

(57) ABSTRACT

An image forming apparatus includes an endless belt, an image forming unit configured to form an image on the recording medium conveyed by the endless belt, a guide surface configured to guide a first surface of the recording medium to the endless belt, a pressing portion configured to press a center portion, in a width direction perpendicular to a conveyance direction, of a leading end of the recording medium from a second surface toward the guide surface, a moving portion disposed upstream relative to the pressing portion in the conveyance direction and configured to contact the recording medium and move according to a pressing force to be applied from the recording medium, and a transmission portion configured to transmit movement of the moving portion to the pressing portion and reduce a pressing force of the pressing portion in accordance with the movement of the moving portion.

14 Claims, 8 Drawing Sheets

(56) References Cited

U.S. PATENT DOCUMENTS

| | | | | |
|---|---|---|---|---|
| 7,815,181 | B2 * | 10/2010 | Okuno | 271/3.14 |
| 7,992,870 | B2 * | 8/2011 | Yamaguchi | 271/273 |
| 8,025,292 | B2 * | 9/2011 | Takeshita | 271/274 |
| 2007/0231032 | A1 * | 10/2007 | Matsuno | 399/388 |
| 2009/0226210 | A1 * | 9/2009 | Hayakawa et al. | 399/116 |
| 2010/0021218 | A1 * | 1/2010 | Watanabe et al. | 399/361 |
| 2010/0230892 | A1 * | 9/2010 | Tanioka | 271/225 |

FOREIGN PATENT DOCUMENTS

| | | |
|---|---|---|
| JP | 2009-210903 | 9/2009 |
| JP | 2010-026320 | 2/2010 |
| JP | 2010-047420 | 3/2010 |
| JP | 2010-066391 | 3/2010 |

* cited by examiner

IMAGE FORMING APPARATUS

CROSS REFERENCE TO RELATED APPLICATION

This application claims priority from Japanese Patent Application No. 2011-237261, filed on Oct. 28, 2011, the entire subject matter of which is incorporated herein by reference.

FIELD

Aspects of the disclosure relate to an image forming apparatus configured to form an image on a recording medium while conveying the recording medium on an endless belt, more specifically to, a mechanism for guiding a recording medium to the endless belt.

BACKGROUND

A known image forming apparatus is configured to form an image on a recording medium, e.g., a sheet of paper, while conveying the sheet on an endless belt. The image forming apparatus may include a color laser printer of a direct transfer tandem type. In the image forming apparatus, a sheet to be conveyed by the endless belt may be subject to a phenomenon where a center portion of the sheet in a direction perpendicular to a sheet conveying direction (hereinafter referred to as a width direction) is conveyed in advance of side portions of the sheet in the width direction. Hereinafter, the phenomenon is referred to as "center portion advance conveyance."

In a case where a plurality of sheets are left stacked in conditions of high temperature and high humidity, if upper stacked sheets are excluded, only peripheral edges of the remaining sheets may be exposed to the hot and humid surroundings. Thus, the sheets may remain dry in the center portion while being damp in both side portions, in the width direction, where water is absorbed from the air. Such sheets may be stiff in the center portion and soft in both side portions, and thus may suffer some warping at both side portions.

During conveying of sheets, if a center portion of a sheet is conveyed in advance of side portions of the sheet before the sheet is conveyed to the endless belt, a center portion of a leading end of the sheet contacts the endless belt in advance of side portions of the leading end of the sheet in the width direction. Thus, the sheet may suffer forces acting from both sides of the sheet to the center portion thereof in a direction from the leading end to a trailing end of the sheet.

If a sheet has a stiff center portion and soft side portions, forces acting from both side portions to the center portion may react upon the elasticity in the center portion of the sheet, and thus the sheet may crease. If a toner image is transferred to a sheet having a crease in the center portion, the toner image is improperly transferred in a creased portion of the sheet. In addition, a sheet having a crease may not be properly conveyed. For these reasons, it has been proposed to prevent the center portion advance conveyance by applying resistance to a center portion of a leading end of a sheet in the width direction greater than to side portions of the leading end of the sheet in the width direction when the sheet is conveyed to the endless belt.

However, when resistance is applied to the center portion of the leading end of the sheet in the width direction, a phenomenon may occur that the center portion of the leading end of the sheet is conveyed later than the side portions of the leading end of the sheet. This phenomenon may occur irrespective of surrounding environment such as temperature and humidity, and a type of a sheet. Thus, it is necessary to apply resistance to the center of a sheet in conditions of high temperature and high humidity where a crease occurs in the sheet due to the center portion advance conveyance. However, it is not necessary to apply resistance to the center of a sheet in normal conditions where a crease is less likely to occur in the sheet even if the center portion advance conveyance occurs. Thus, providing for a switching member to switch whether resistance is applied or not is proposed.

However, as the switching member is manually operated, additional work is required and the structure of the device is complicated. If a user fails to operate the switching member, an unacceptable image may be formed. Moreover, whether a sheet creases, in other words, whether resistance is applied to a center portion of a sheet, depends on not only temperature and humidity but also stiffness of the sheet.

SUMMARY

Illustrative aspects of the disclosure provide an image forming apparatus configured to form acceptable images by changing over whether resistance to control the center portion advance conveyance is applied or not automatically in response to stiffness of a recording medium.

According to an aspect of the disclosure, an image forming apparatus includes a drive roller and a driven roller spaced apart from the drive roller, an endless belt extending around the drive roller and the driven roller, an image forming unit configured to form an image on the recording medium conveyed by the endless belt, a guide surface configured to guide a first surface of the recording medium to be conveyed to the endless belt, a pressing portion configured to press a center portion, in a width direction perpendicular to a conveyance direction where the recording medium is conveyed, of a leading end of the recording medium to be conveyed on the guide surface from a second surface, opposite to the first surface, toward the guide surface, a moving portion disposed upstream relative to the pressing portion in the conveyance direction and configured to contact the recording medium to be conveyed to the pressing portion and move according to a pressing force to be applied from the recording medium, and a transmission portion configured to transmit movement of the moving portion to the pressing portion and reduce a pressing force of the pressing portion in accordance with the movement of the moving portion.

BRIEF DESCRIPTION OF THE DRAWINGS

Illustrative aspects will be described in detail with reference to the following figures in which like elements are labeled with like numbers and in which.

DETAILED DESCRIPTION

Figure 1:
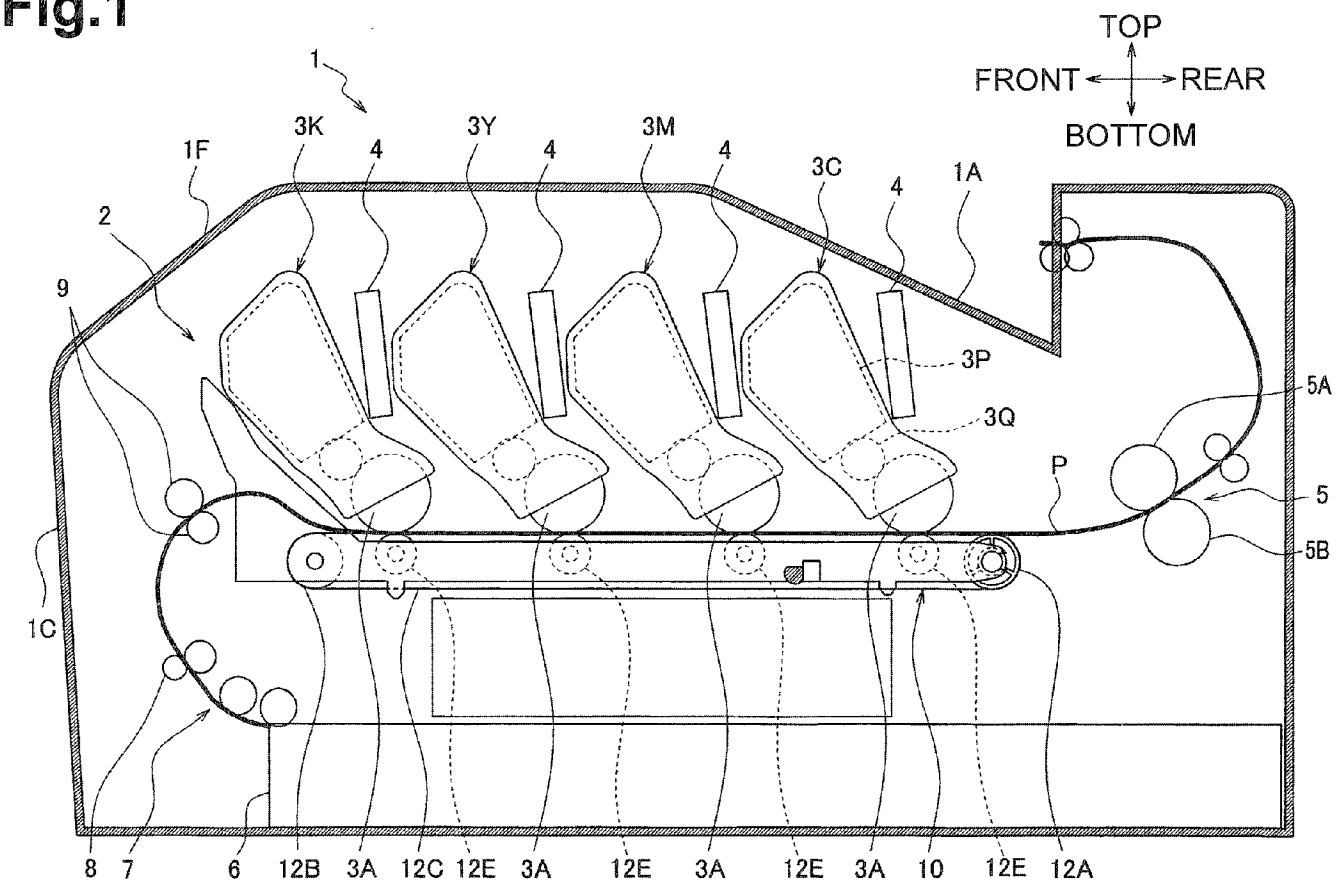
FIG. 1 is a cross sectional view schematically illustrating a structure of an image forming apparatus according to aspects of the disclosure.

An illustrative embodiment will be described in detail with reference to the accompanying drawings. Aspects of the disclosure may be applied to an image forming apparatus 1 as shown in FIG. 1. In the following description, the left side in FIG. 1 is referred to as the front side of the image forming apparatus 1, and the right side is referred to as the rear side of the image forming apparatus 1.

As shown in FIG. 1, the image forming apparatus 1 includes an image forming portion 2 configured to form an image on a recording medium, e.g., a plain sheet of paper, a transparency (hereinafter referred to as a sheet P). The image forming portion 2 includes four process cartridges 3K, 3Y, 3M, and 3C, an exposure unit 4, a fixing unit 5, and a belt unit 10. In this embodiment, the image forming portion 2 uses a direct tandem method to form a color image on a sheet P by overlaying four toner images formed by the four process cartridges 3K, 3Y, 3M, and 3C corresponding to four colors of black, yellow, magenta, and cyan, one above another on the sheet P.

Sheets P are stacked in a sheet supply cassette 6 disposed below the image forming portion 2. A sheet P located highest in a stack direction is picked up from the sheets P in the sheet supply cassette 6 by a sheet supply mechanism (or a feeder portion) 7, and is fed to a dust removing roller 8 by which paper dust is removed from the sheet. The sheet P is then fed to registration rollers 9. The registration rollers 9 correct skew of the sheet P and feed the sheet P to a belt unit 10 at a specified timing. The four process cartridges 3K, 3Y, 3M, and 3C are disposed facing a surface of the belt unit 10 on which a sheet is fed and arranged in line and in this order from an upstream side in a sheet feed direction.

Thus, four types of toner images are transferred sequentially on the sheet P being fed on the belt unit 10, and the toner images completely transferred onto the sheet P are fixed thermally by the fixing unit 5. The sheet P ejected from the fixing unit 5 is turned upward and ejected to an ejection tray 1A disposed on an upper surface of the image forming apparatus 1.

Each of the process cartridges 3K, 3Y, 3M, and 3C includes a photosensitive drum 3A, a charger (not shown), and a developer cartridge 3P as an example of a toner cartridge. The photosensitive drum 3A is configured to carry a toner image thereon. The charger is configured to charge the photosensitive drum 3A. The developer cartridge 3P is configured to supply toner to the photosensitive drum 3A. A peripheral surface of the photosensitive drum 3A charged by the charger is exposed by the exposure unit 4 to form an electrostatic latent image. When toner is supplied from the developer cartridge 3P to the electrostatic latent image, the electrostatic latent image is developed into a toner image carried on the peripheral surface of the photosensitive drum 3A, and the toner image is transferred onto the sheet P. The developer cartridge 3P is configured to contain toner therein and to supply toner to the photosensitive drum 3A while frictionally charging the toner by a developing roller 3Q.

The fixing unit 5 includes a heat roller 5A and a pressure roller 5B. The heat roller 5A is configured to fix the toner image onto the sheet P by heat. The pressure roller 5B is disposed facing the heat roller and configured to press the sheet P to the heat roller 5A.

The belt unit 10 is disposed facing each photosensitive drum 3A of the process cartridges 3K, 3Y, 3M, and 3C and is configured to convey a sheet P. Specifically, the belt unit 10 includes a drive roller 12A and a driven roller 12B whose rotation axes are parallel to a rotation axis of the photosensitive drum 3A, and a transfer conveyance belt 12C (as an example of an endless belt) extending around the drive roller 12A and the driven roller 12B. A sheet P is conveyed while being placed (or adhered) on the transfer conveyance belt 12C. The drive roller 12A receives a drive force from a motor (not shown) disposed in a main body frame (not shown) of the main body, drive to rotate the transfer conveyance belt 12C, and the driven roller 12B follows rotation of the drive roller 12A along with rotation of the transfer conveyance belt 12C.

An extension surface of the transfer conveyance belt 12C, which faces to each photosensitive drum 3A of the process cartridges 3K, 3Y, 3M, and 3C, serves as a flat conveyance surface for conveying a sheet P, and substantially agree with a horizontal surface in this embodiment. The belt unit 10 includes transfer rollers 12E in a loop of the transfer conveyance belt 12C. The transfer rollers 12E are disposed at positions corresponding to the photosensitive drums 3A to sandwich the transfer conveyance belt 12 between the transfer rollers 12E and the photosensitive drums 3A and configured to transfer toner images carried on the photosensitive drums 3A onto a sheet P upon receipt of a consistent transfer current.

The process cartridges 3K, 3Y, 3M, and 3C and the belt unit 10 are detachably attached to the main body frame of the main body covered by a casing 1C forming an aesthetic surface. The casing 1C includes a top cover 1F on which the ejection tray 1A is disposed. The top cover 1F is pivotally attached to the casing 1C. The process cartridges 3K, 3Y, 3M, and 3C can be replaced by releasing the top cover 1F upward.

A sheet guide mechanism 20 is disposed in a sheet conveyance path from the registration rollers 9 to the surface of the transfer conveyance belt 12C.

Figure 2:
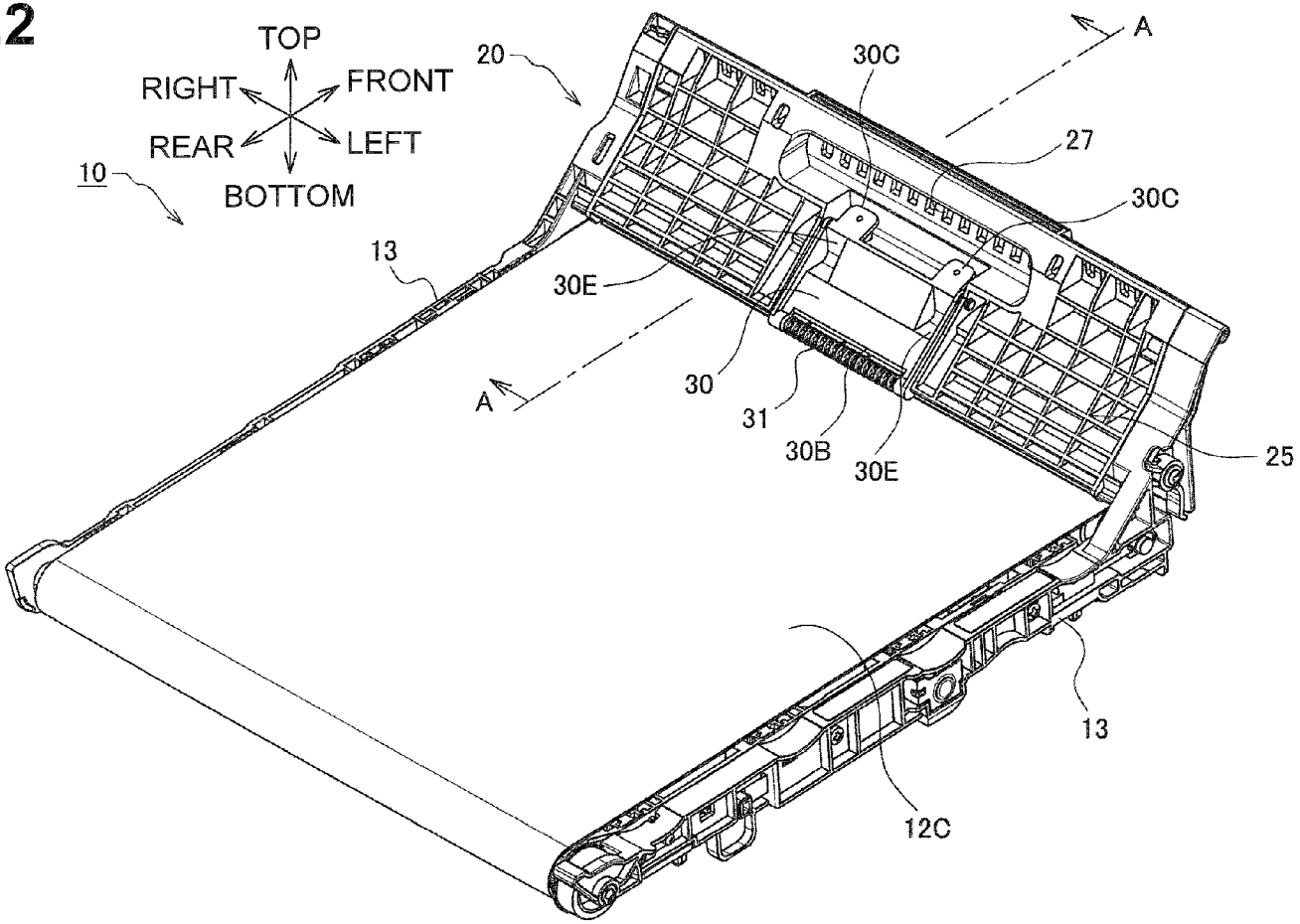
FIG. 2 is a perspective view of a belt unit of the image forming apparatus.
Figure 3:
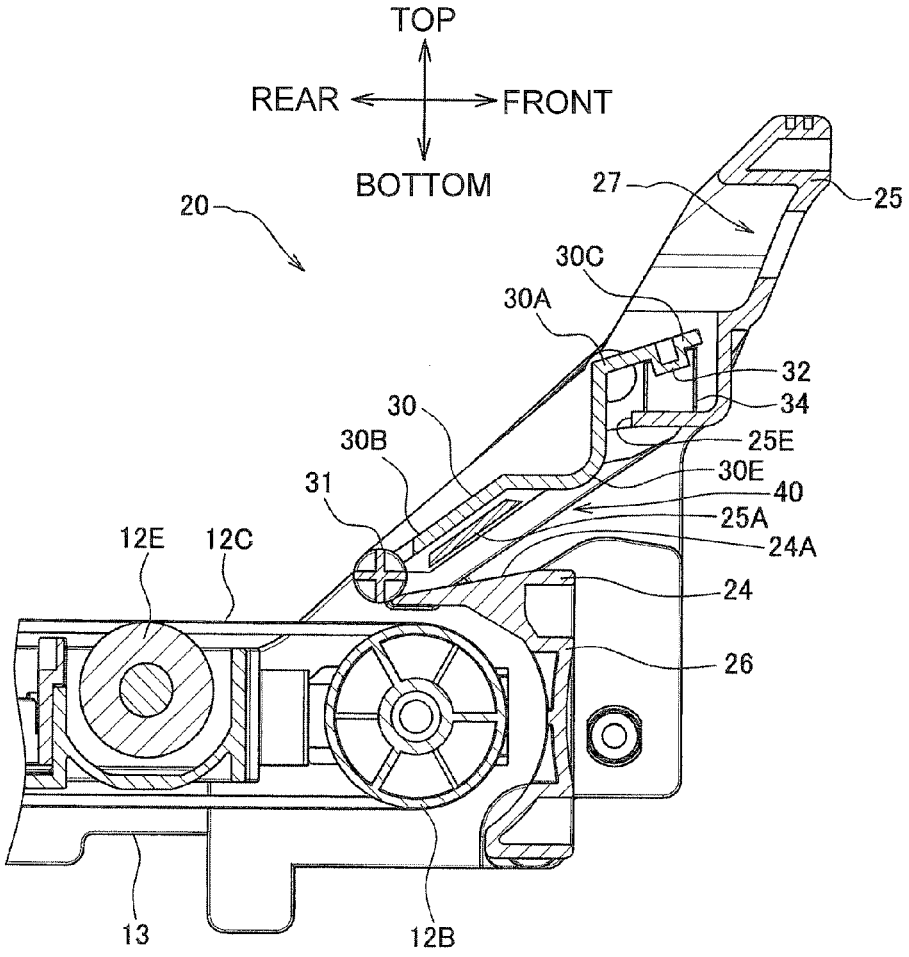
FIG. 3 is a cross sectional view illustrating a structure of a sheet guide mechanism of the belt unit.

FIG. 2 is a perspective view illustrating the belt unit 10 including the sheet guide mechanism 20, looking from the left rear side. FIG. 3 is a cross section illustrating the sheet guide mechanism 20 taken along the line A-A of FIG. 2. As shown in FIG. 2, the belt unit 10 further includes left and right belt unit side frames 13 which support both ends of the drive roller 12A, the driven roller 12B, and the transfer rollers 12E in their axial direction. The left and right belt unit side frames 13 are connected by members (not shown), are thin vertically and have a rectangular shape in a side view.

As shown in FIGS. 2 and 3, the sheet guide mechanism 20 is disposed in an upper portion of the front end of the belt unit 10 and includes a first guide member 24 and a second guide member 25 on an upstream side (or front side) of the transfer conveyance belt 12C in the sheet conveyance direction.

The first guide member 24 is shaped like a plate, which is elongated in a width direction perpendicular to the sheet conveyance direction, and wider than the transfer conveyance belt 12C. Although it is not shown, the first guide member 24 is supported by the belt unit 10 such that it extends between front ends of the left and right belt unit side frames 13 of the belt unit 10. With this state, the first guide member 24 faces, from above, a portion of the transfer conveyance belt 12C corresponding to an upper end portion of the driven roller 12B. Thus, any portion of the first guide member 24 does not contact the transfer conveyance belt 12C. The upper surface of the first guide member 24 is inclined downward to the rear side, and is regarded as a first guide surface 24A (as an example of a guide surface). The first guide surface 24A is inclined such that it gets near the upper side of the transfer conveyance belt 12C from above as it goes to the rear side (downstream side in the sheet conveyance direction).

A guard 26 is integrally attached to the front end of the belt unit 10 such that the guard 26 connects the front ends of the left and right belt unit side frames 13 (FIG. 2). The guard 26 extends downward along a curved portion at the front end of the transfer conveyance belt 12C which is curved along the peripheral surface of the drive roller 12B. The guard 26 is disposed facing the curved portion of the transfer conveyance belt 12C at a specified distance. Thus, the guard 26 protects the curved portion of the transfer conveyance belt 12C from the front. The first guide member 24 is integrally formed at the upper end portion of the guard 26.

The second guide member 25 is shaped like a plate elongated in the width direction and having substantially the same width as the first guide member 24. As shown in FIG. 3, the second guide member 25 is disposed above the first guide member 24 and between the front ends of the left and right belt unit side frames 13 at a distance from the transfer conveyance belt 12C.

As shown in FIG. 3, the second guide member 25 is disposed facing the first guide member 24 from above and spaced away therefrom. The entire of the second guide member 25 is inclined downward to the rear side as in the case with the first guide surface 24A. Specifically, an inclined angle of the second guide member 25 with respect to a horizontal surface (upper portion of the transfer conveyance belt 12C) is greater than an inclined angle of the first guide surface 24A with respect to the horizontal surface.

Thus, a space 40 sandwiched vertically between the first guide surface 24A and a second guide surface 25A is shaped in substantially a triangle narrowing to the rear side in cross sectional view of FIG. 3. In other words, a vertical space between the first guide surface 24A and the second guide surface 25A spreads toward the upstream side in the sheet conveyance direction or toward the front side. The space 40 is wider than a sheet P in the width direction as viewed from the top. The space 40 extends from an upper front portion of the transfer belt 12C and is released to the front side. The registration rollers 9 (FIG. 1) are disposed in front of the space 40.

As shown in FIG. 2, an upper portion of the upper surface of the second guide member 25 has a long hole 27 in a central portion in the width direction. The long hole 27 is elongated in the width direction. The belt unit 10 can be removed and attached relative to the main body frame by grasping the edge of the long hole 27.

A lever 30 and a pressing member 31 are disposed in a central portion of the upper surface of the second guide member 25 below the long hole 27. The lever 30, as an example of a transmission portion, is supported by the second guide member 25. The pressing member 31, as an example of a pressing portion, is supported by the lever 30. The lever 30 is shaped like a rectangular plate slightly elongated in the width direction as viewed from the top, and has a size enough to fit in an area below the long hole 27 in the upper surface of the second guide member 25.

The lever 30 is inclined downward to the rear side along the second guide member 25 and is pivotally supported by the second guide member 25. As shown in FIG. 3, a pivot center of the lever 30 is located in a position shifted slightly upward or frontward from the center of the lever 30 in a vertical direction (or front-rear direction). A pivot shaft 30A of the lever 30 extends in the width direction such that its axis passes through the pivot center. The pivot shaft 30A is sandwiched between a lower end (or rear end) 30B of the lever 30 and an upper end (or front end) 30C of the lever 30. When the lever 30 pivots, the lower end 30B and the upper end 30C moves vertically. Specifically, when the lower end 30B rises, the upper end 30C lowers, and when the lower end 30B lowers, the upper end 30C rises.

A boss 32 protruding downward is integrally formed in a lower surface of the upper end 30C of the lever 30. A compression coil spring 34 is interposed between the boss 32 and an upper surface of the second guide member 25. The upper end 30C having the boss 32 is urged upward by the compression coil spring 34 that will stretch upward. With this structure, the lever 30 is entirely urged such that it pivots counterclockwise in FIG. 3, and thus the lower end 30B is urged downward.

The pressing member 31 is a roller having an axis extending in the width direction. The pressing member 31 is rotatably supported by the lower end 30B of the lever 30. In other words, the pressing member 31 is supported by the second guide member 25 via the lever 30.

As the lever 30 is pivotable, the pressing member 31 moves vertically along with pivoting of the lever 30. With this structure, the pressing member 31 is configured to contact and separate from a rear end portion of the first guide surface 24A. Under no external force applied, the upper end 30C of the lever 30 is urged by the compression coil spring 34 and the lower end 30B is urged downward. Thus, the pressing member 31 supported by the lower end 30B is urged downward to the rear end portion of the first guide surface 24A. Thus, when there is nothing between the pressing member 31 and the first guide surface 24A, the pressing member 31 contacts the rear end portion of the first guide surface 24A, which is a downstream end portion in the sheet conveyance direction, from above.

Figure 4:
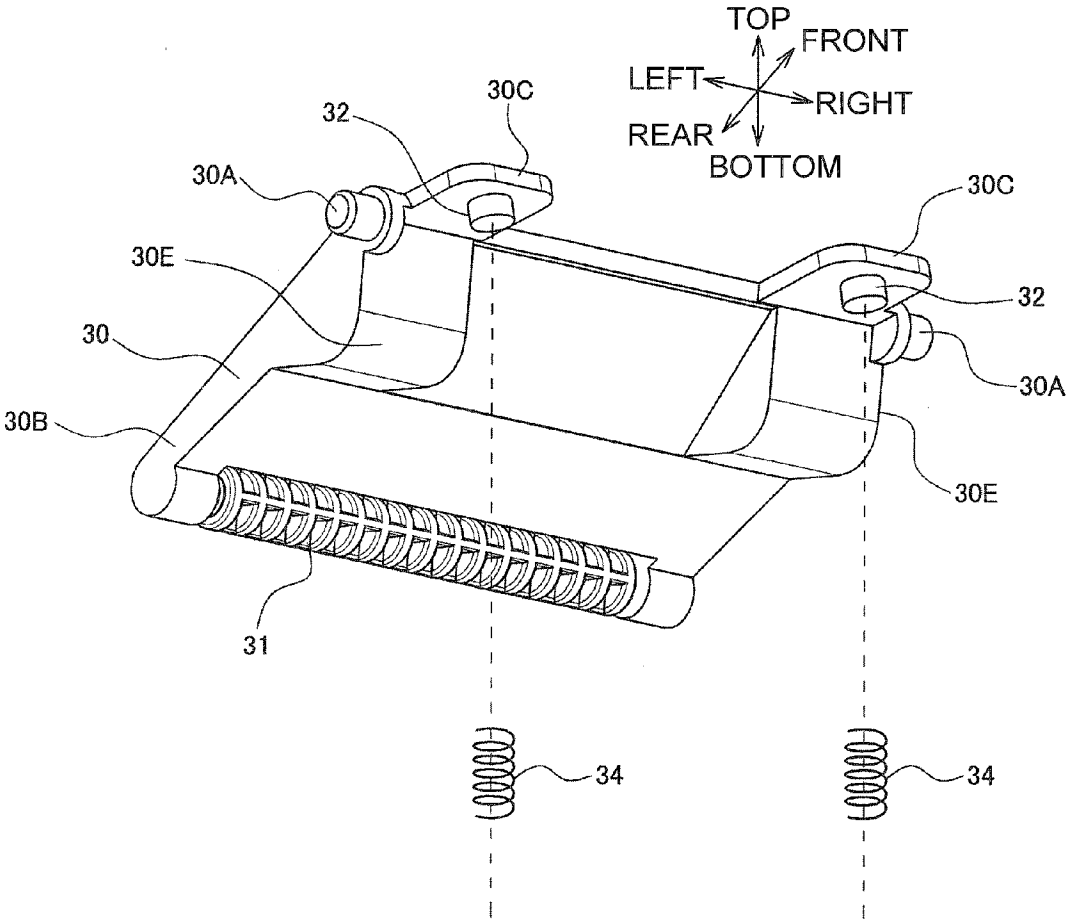
FIG. 4 is an exploded perspective view illustrating components around a lever of the sheet guide mechanism.

A lower surface of the lever 30 (specifically, a rear portion from the pivot shaft 30A) is disposed above the second guide member 25 in parallel therewith, the lower end 30B protrudes downward (or rearward) more than a lower end (rear end) of the second guide member 25 and faces the first guide surface 24A. Near the lower end 30B, the pressing member 31 is disposed in contact with a lower end of the first guide member 24A. The lower surface of the lever 30 has a protrusion 30E at a position shifted from the pivot shaft 30A slightly toward the lower end 30B. The protrusion 30E protrudes toward the space 40 and is shaped in substantially an isosceles triangle in side view. The second guide member 25 has a hole 25E through which the protrusion 30E protrudes downward more than the second guide surface 25A (within the space 40). As shown in the exploded perspective view of FIG. 4, the protrusion 30E is disposed on each side of the lever 30 in the width direction. The protrusions 30E are aligned along the sheet conveyance direction.

In this embodiment, a sheet P conveyed by the registration rollers 9 is conveyed rearward, and goes into the space 40 (sandwiched by the first guide surface 24A and the second guide surface 25A vertically) from the front side. When the sheet P goes into the space 40, a part of the sheet P contacts the protrusions 30E. The sheet P then contacts the second guide surface 25A and is conveyed diagonally downward within the space 40 along the second guide surface 25A. Then, the sheet P reaches a contact portion between the pressing member 31 and the rear end portion of the first guide surface 24A. In this manner, the second guide member 25 guides the sheet P toward the transfer conveyance belt 12C located downstream along the second guide surface 25A.

In the sheet P, only the center portion in the width direction reaches the contact portion between the pressing member 31 and the rear end portion of the first guide surface 24A. When the center portion of the sheet P reaches the contact portion between the pressing member 31 and the rear end portion of the first guide surface 24A, the sheet P is sandwiched by the registration rollers 9 and conveyed rearward by the registration rollers 9.

The center portion at the leading end of the sheet P pushes the pressing member 31 upward against the urging force of the compression coil spring 34, causing the pressing member 31 to separate from the rear end portion of the first guide surface 24A. The pressing member 31 intends to return to the rear end portion of the first guide surface 24A because of the restoring force (urging force) of the compression coil spring 34. At this time, the pressing member 31 presses only the center portion of the sheet P to the first guide surface 24A toward the first guide surface 24A such that the center portion of the sheet P is sandwiched between the pressing member 31 and the first guide surface 24A. The sheet P passes between the first guide surface 24A and the second guide surface 25A and is conveyed rearward while receiving a greater resistance at the center portion of the sheet P than at both sides thereof. Thus, the center portion advance conveyance is controlled. The center portion of the sheet P is not conveyed in advance of both sides thereof, and the sheet P can be smoothly conveyed toward the transfer conveyance belt 12C.

Figure 8:
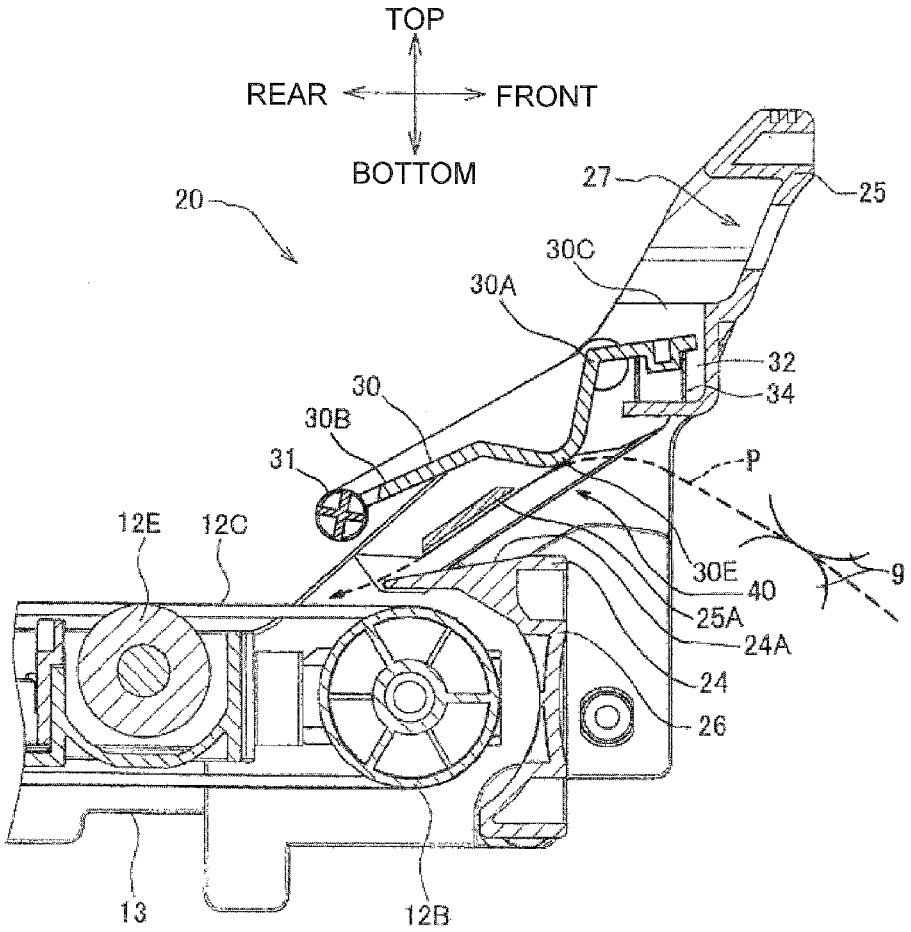
FIG. 8 illustrates operation of a moving member in the aspects of the disclosure shown in FIGS. 1 to 4.

As described above, when the sheet P goes into the space 40, a part of the sheet P contacts the protrusions 30E. At this time, the protrusions 30E move upward against the urging force of the compression coil spring 34 in response to the force received from the sheet P, which pushes the pressing member 31 upward accordingly. The amount of movement of the protrusions 30E increases with a sheet P having stronger stiffness. The greater the amount of the movement of the protrusions 30E is, the smaller the pressing force of the pressing member 31 is (in other words, the smaller the resistance applied to the center portion of the sheet P is). Especially when the sheet P is stiff like a cardboard, as shown in FIG. 8, the pressing member 31 is pushed upward such that it is separated from the rear end portion of the first guide surface 24A. Thus, in this embodiment, regarding a soft sheet P, which is unlikely to crease on the transfer conveyance belt 12C even if the center portion advance conveyance occurs, the application of the resistance by the pressing member 31 is automatically prevented before the leading end of the sheet P reaches the pressing member 31. Thus, an image can be formed properly on the sheet P. When the sheet P is soft, the amount of movement of the protrusions 30E is small. Thus, to reduce the potential for occurrence of the center portion advance conveyance, an adequate resistance is applied to the center portion of the sheet P in the width direction, and the sheet P is prevented from being creased on the transfer conveyance belt 12C.

Thus, in this embodiment, an image can be properly formed on the sheet P, which is stiff or soft. Moreover, in this embodiment, the protrusions 30E are spaced apart from and disposed upstream relative to the pressing member 31 in the sheet conveyance direction. Thus, compared with a case where the protrusions 30E and the pressing member 31 are disposed close to each other, the resistance applied from the protrusions 30E to the sheet P contributes little to the state of the sheet P transferred onto the transfer conveyance belt 12C, and an image can be formed on the sheet P more reliably. In addition, in this embodiment, as the lever 30 is simply structured to include the protrusions 30E and the pressing member 31, the structure of the apparatus can be simplified and the cost of manufacturing can be reduced.

Figure 5:
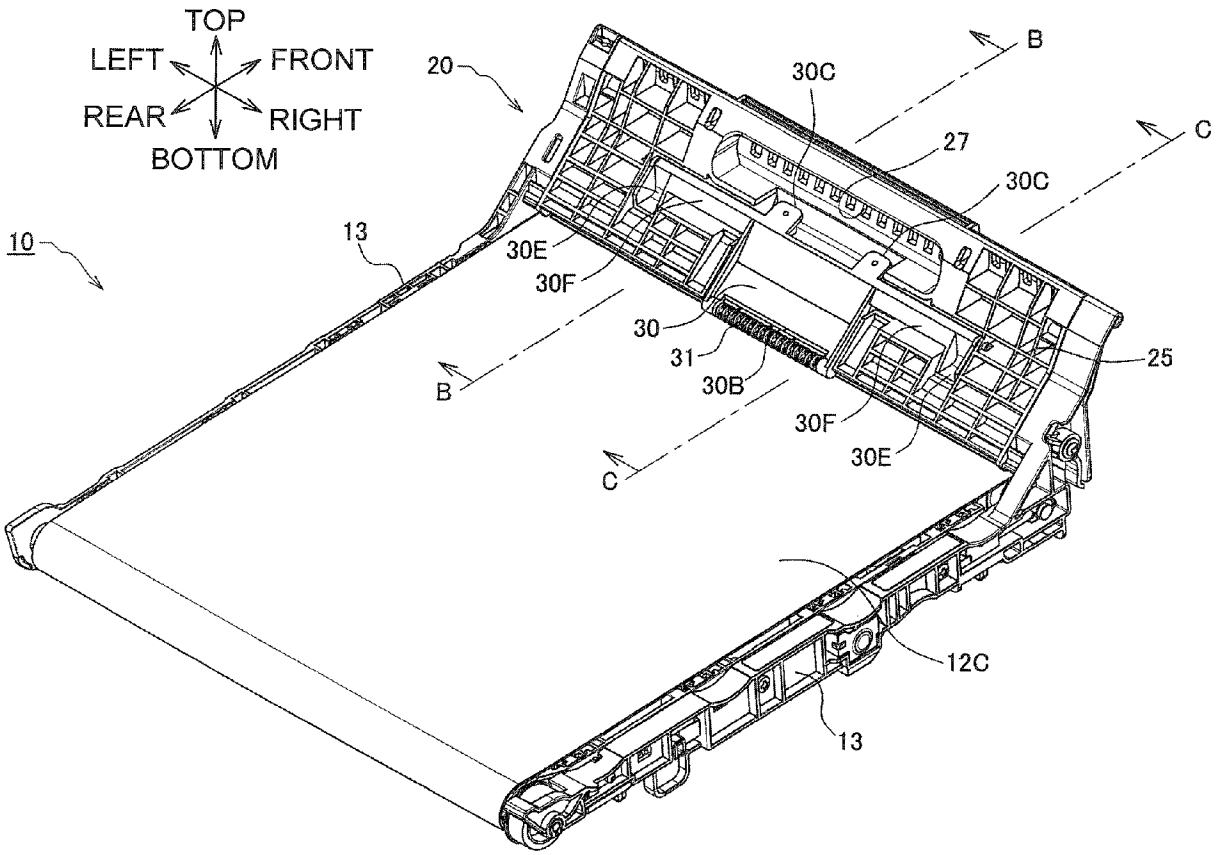
FIG. 5 is a perspective view illustrating a structure of a belt unit according to another embodiment.
Figure 6A:
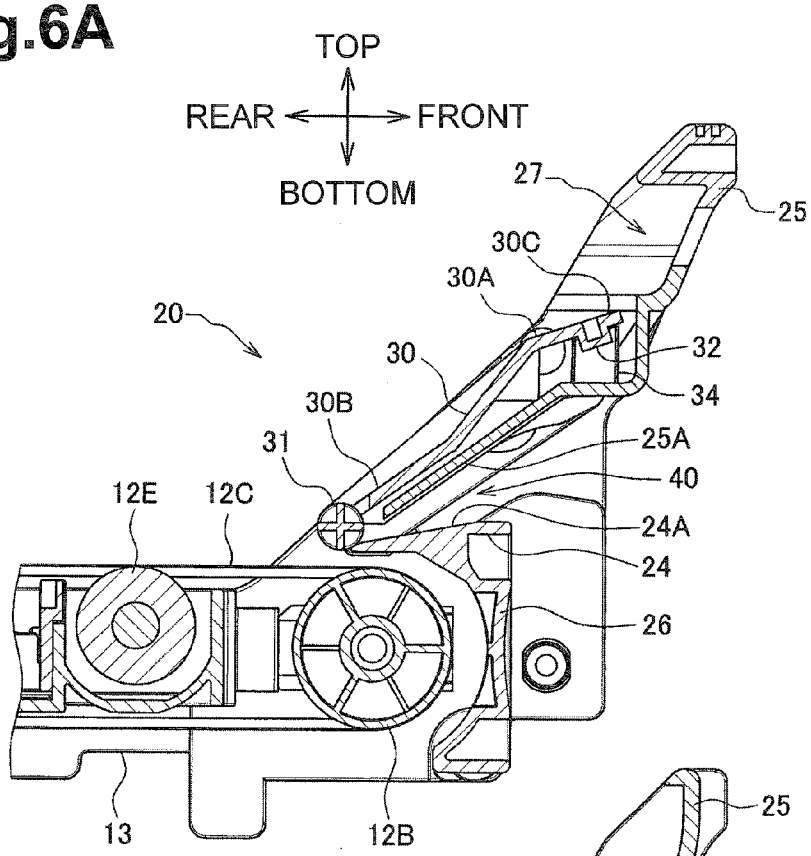
FIGS. 6A and 6B are cross sectional views illustrating a structure of a sheet guide mechanism of the belt unit.
Figure 6B:
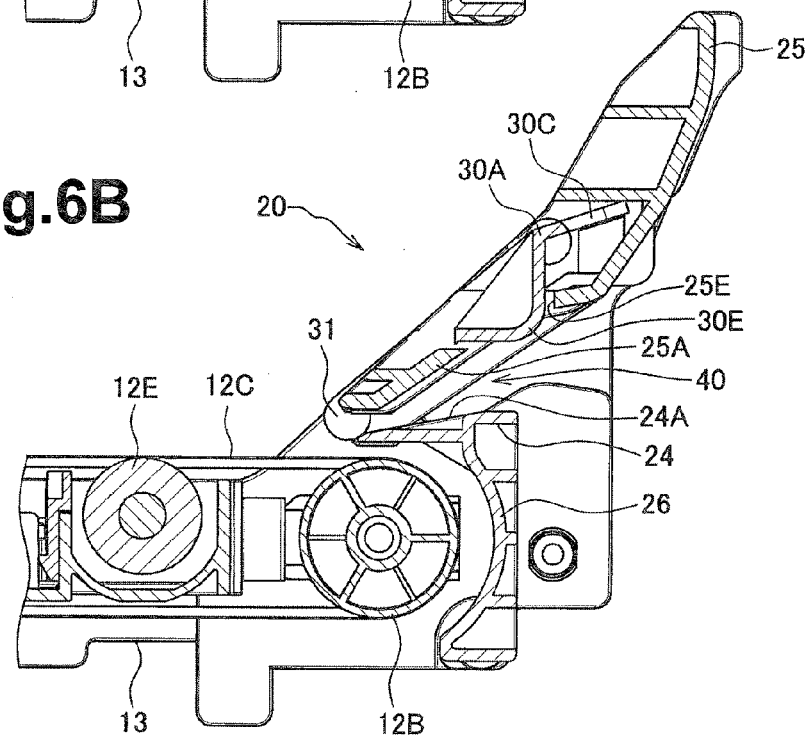
Figure 7:
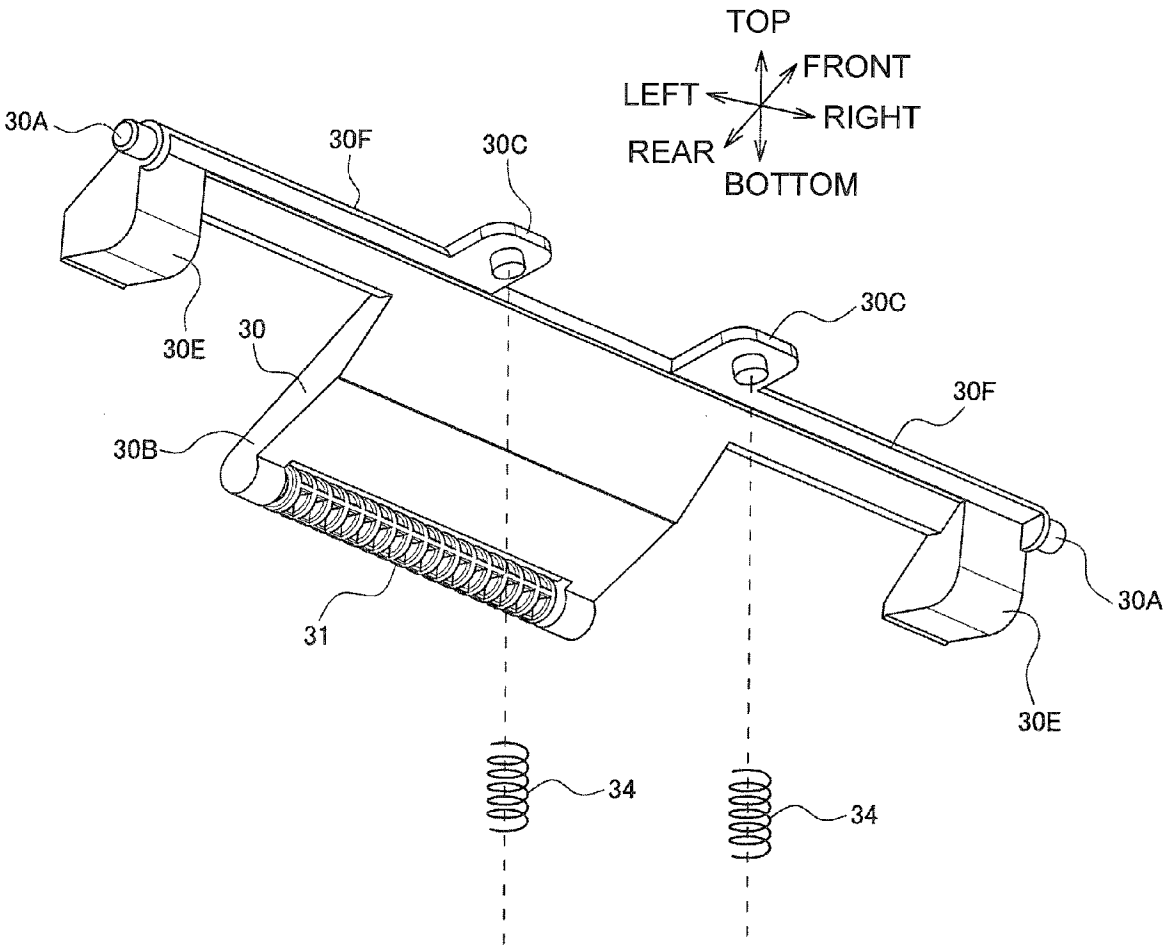
FIG. 7 is an exploded perspective view illustrating components around a lever of the sheet guide mechanism.

The disclosure is not limited to this kind of lever 30. As shown in FIGS. 5-7, the protrusions 30E may be disposed on ends of respective extension portions 30F, which extend from both sides of the lever 30 in the width direction. In this case, the resistance applied from the protrusions 30E does not concentrate on the center portion of a sheet P, and thus an image can be formed on the sheet P more reliably.

The pressing member 31 may be a bulge that does not rotate like a roller. Conversely, a roller may be disposed at an end of each protrusion 30E which contacts a sheet P. In this case, the resistance which the protrusions 30E apply to the sheet P can be reduced. Moreover, the compression coil spring 34 may be eliminated and the weight of the lever 30 may be used to apply resistance to the sheet P via the pressing member 31. Furthermore, the protrusions 30E may be disposed on a member pivotally supported relative to the second guide member 25, differently from the lever 30. With this structure, the movement of the protrusions 30E is transmitted to the compression coil spring 34, such that the urging force is reduced. Furthermore, in this embodiment, the sheet conveyance path is defined such that an image formation surface of the sheet P (corresponding to a second surface) protrudes. However, the sheet conveyance path may be defined such that a surface opposite to the image formation surface (corresponding to a first surface) protrudes. In this case, the protrusions 30E may be disposed so as to contact the surface of the sheet P opposite to the image formation surface.

Aspects of the disclosure may be applied to other types of image forming apparatuses, such as an inkjet printer configured to form an image on a recording medium being conveyed by an endless belt. However, in an electrophotographic printer configured to form an image on a recording medium, i.e., a sheet, which is conveyed by an endless belt, i.e., the transfer conveyance belt 12C, by passing a current through the sheet, as shown in the above embodiment, the sheet is electrostatically attracted to the endless belt. Even if a sheet creases or side portions of a leading end of the sheet is conveyed in advance of a center portion of the leading end of the sheet, such problems may not be resolved under natural conditions. Thus, the above embodiment remarkably shows the effects of the disclosure.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a drive roller and a driven roller spaced apart from the drive roller;

an endless belt extending around the drive roller and the driven roller, the endless belt being configured to be driven to rotate and convey a recording medium;

an image forming unit configured to form an image on the recording medium conveyed by the endless belt;

a guide having a first guide surface and a second guide surface facing the first guide surface from above, the first guide surface being configured to guide a first surface of the recording medium to be conveyed to the endless belt, the first guide surface and the second guide surface defining a space in which the recording medium is to be conveyed, the second guide surface being configured to guide a second surface, opposite to the first surface of the recording medium, to be conveyed to the endless belt;

a pivotable member configured to pivot about a pivot axis disposed upstream relative to the second guide surface in a conveyance direction in which the recording medium is conveyed, the pivotable member including:

a pressing portion disposed downstream relative to the pivot axis in the conveyance direction and in parallel to the pivot axis, the pressing portion being configured to press in a pressing direction toward the first guide surface of the guide; and first and second protrusions spaced apart from each other in a direction in which the pivot axis extends, the first and second protrusions being disposed downstream relative to the pivot axis, upstream relative to the pressing portion, and closer to the pivot axis disposed upstream relative to the second guide surface than to the pressing portion in the conveyance direction, the first and second protrusions being configured to contact the recording medium conveyed to the endless belt and be pressed by the recording medium such that the first and second protrusions receive a force from the recording medium to be urged in a first pivot direction, the pressing portion being configured to contact the first guide surface of the guide when the first and second protrusions do not contact the recording medium; and an urging member configured to urge the pivotable member in a second pivot direction opposite to the first pivot direction, wherein the first and second protrusions, spaced apart from each other in the direction in which the pivot axis extends and disposed closer to the pivot axis disposed upstream relative to the second guide surface than to the pressing portion in the conveyance direction, protrude in the second pivot direction toward the space more than the second guide surface of the guide and more than a portion of the pivotable member that is between the first and second protrusions, and the first and second protrusions are configured to move relative to the second guide surface of the guide.

2. The image forming apparatus according to claim 1, wherein the pressing portion includes a roller configured to be rotated by the recording medium.

3. The image forming apparatus according to claim 1, wherein the pressing portion is disposed such that the endless belt faces the pressing portion.

4. The image forming apparatus according to claim 1, wherein the urging member has a weight to urge the pivotable member in the second pivot direction by the weight thereof.

5. The image forming apparatus according to claim 1, wherein the urging member is configured to urge an upstream end of the pivotable member upward.

6. The image forming apparatus according to claim 1, wherein the first and second protrusions are configured to contact the second surface of the recording medium.

7. The image forming apparatus according to claim 1, wherein an upstream end of the pivotable member in the conveyance direction is disposed above the pressing portion and the pressing portion is disposed above the endless belt.

8. The image forming apparatus according to claim 1, wherein the first and second protrusions overlap the pressing portion in the conveyance direction.

9. The image forming apparatus according to claim 1, wherein the first and second protrusions do not overlap the pressing portion in the conveyance direction.

10. The image forming apparatus according to claim 1, wherein when the recording medium contacts the first and second protrusions a central portion of the recording medium, which extends in the conveyance direction, does not contact the pivotable member.

11. The image forming apparatus according to claim 1, wherein the pressing portion is configured to press a central portion of the recording medium, which extends in the conveyance direction, in the pressing direction toward the first guide surface of the guide.

12. The image forming apparatus according to claim 1, wherein the second guide surface has a hole through which the first and second protrusions protrude in the second pivot direction more than the second guide surface when the recording medium does not contact the first and second protrusions.

13. The image forming apparatus according to claim 1, wherein the second guide surface extends along the pivotable member when viewed in the direction in which the pivot axis extends.

14. The image forming apparatus according to claim 1, wherein the first and second protrusions are disposed in an upper portion of the pivotable member when viewed in the direction in which the pivot axis extends.

* * * * *